US008351616B1

(12) United States Patent
Graber

(10) Patent No.: US 8,351,616 B1
(45) Date of Patent: Jan. 8, 2013

(54) ARRAY OF MULTIPLE LF TRANSDUCERS WITH ULTRAHIGH CARDIOID SOUND PATTERN GENERATION

(76) Inventor: Curtis E. Graber, Woodburn, IN (US)

( * ) Notice: Subject to any disclaimer, the term of this patent is extended or adjusted under 35 U.S.C. 154(b) by 1860 days.

(21) Appl. No.: 11/286,761

(22) Filed: Nov. 23, 2005

(51) Int. Cl.
*H04R 1/02* (2006.01)

(52) U.S. Cl. ..... 381/89

(58) Field of Classification Search ..... 381/89, 381/335, 97, 80, 182, 184, 186, 387, 395, 381/199; 367/153, 154, 905; 181/144, 147
See application file for complete search history.

(56) References Cited

U.S. PATENT DOCUMENTS

| | | | | |
|---|---|---|---|---|
| 4,363,115 | A | 12/1982 | Cuomo | |
| 4,837,826 | A * | 6/1989 | Schupbach | 381/308 |
| 6,128,395 | A | 10/2000 | DeVries | |
| 6,766,033 | B2 | 7/2004 | Jorgensen et al. | |
| 2005/0169493 | A1 | 8/2005 | Horbach | |
| 2005/0180577 | A1 | 8/2005 | Horbach | |

OTHER PUBLICATIONS

Bob McCarthy. "Directional Bass Using Omnidirectional Components." Sound & Video Contractor. Sep. 21, 2004. http://svconline.com/news/directional_bass_components/.*

M. van der Wal, E. W. Start, and D. de Vries, "Design of Logarithmically Spaced Constant-Directivity Transducer Arrays," J. Audio Eng. Soc., vol. 44, No. 6, pp. 497-507, Jun. 1996.*

John Murray. "Understanding Line Array Systems." Live Sound International. Nov./Dec. 2002. http://www.livesoundint.com/archives/2002/novdec/la.php.*

* cited by examiner

*Primary Examiner* — Yuwen Pan
*Assistant Examiner* — Kile Blair
(74) *Attorney, Agent, or Firm* — Paul W. O'Malley; Susan L. Firestone

(57) ABSTRACT

Differential spacing of loudspeakers in an end fire array is employed to reduce beam spread and, where a ground barrier is present, to suppress any resultant back wave.

10 Claims, 6 Drawing Sheets

ARRAY OF MULTIPLE LF TRANSDUCERS WITH ULTRAHIGH CARDIOID SOUND PATTERN GENERATION

BACKGROUND OF THE INVENTION

1. Technical Field

The invention relates to audio arrays, and more particularly, audio bass arrays exhibiting high directivity in sound field generation.

2. Description of the Problem

The capacity to direct and focus the output from an array of loudspeakers is of great interest. Increased control over direction and focus allows an increased proportion of sound energy generated to be delivered to a precise location and reduces the amount of energy arriving at locations of no interest. In effect the efficiency of the overall system is increased.

As used in this patent the term "directivity pattern" of an array of transducers is a graphical description of a generated sound field at a particular frequency in all directions of a specified plane. The "beam width" of a directivity pattern is the angular distance between two points on either side of the principal axis of the sound field where the sound field is down 6 DB from its value, at the particular distance from the source, along the principal axis.

The present patent concerns primarily bass or low frequency sources, used for generation of sound at or below 200-300 Hz. Bass loudspeakers are typically based on a piston driven, diaphragm type transducer set in one face of a enclosure (which may be ported). Unlike higher frequency devices constructed in the same fashion, they operate effectively as simple (i.e. point) sources.

A long history of analysis exists for linear arrays of simple sources. Transducers laid out in a linear array, all operating at a matched frequency and with equal spacing between adjacent units, generate sound waves which either cancel one another, or reinforce one another, in various directions away from the array. To generate a sound field with a principal axis perpendicular to the linear array and minimal sound away from the ends, all of the simple sources are driven in unison. To produce a so-called "end fire array" the phase relationship of the signal to the transducers is varied. An end fire array is one which produces a sound field with a principal axis aligned with the array.

Examples of linear arrays abound in the art, from acoustic doublets to more complex systems. Consideration of acoustic doublets is instructive of the basic principles involved. In a general sense an acoustic doublet is approximated by a simple diaphragm transducer which is freely mounted (i.e. not in a baffle or enclosure). The transducers are spaced by less than one quarter of wavelength for almost any frequency to be reproduced and the faces of the diaphragm are inherently driven at 180 degrees out of phase with one another to produce an "end fire device". In an acoustic doublet, with the transducers vibrating in opposed phase, the pressure waves cancel one another along axes perpendicular to the axis of alignment of the sources and the principal axis of the sound field generated is defined by the center points of the transducers. While an acoustic doublet is an ideal, the same basic principle applies to more complex systems, optimized for particular frequencies. The arrays of interest here though typically use greater spacing.

U.S. Pat. No. 6,766,033 is an example of a bass array system. The '033 patent provides a mechanism to vary spacing between adjacent pairs of a plurality of transducers among a plurality of predetermined "fixed distances". A common signal source feeds the transducers along separate channels. Each channel includes a variable time delay. Selection of the time delay, taking into account the spacing between transducers, determines the direction of the principal axis of the sound field and illustrates some of the suppression of side lobes possible. The loudspeaker at the "base" of the array is excited first with loudspeakers "forward" from the base unit timed to generate sound based on the propagation delay from the base unit.

U.S. Pat. No. 6,128,395 is directed to a loudspeaker system with controlled directional sensitivity. A loud speaker array is taught in which identical loudspeakers are arranged in a straight line or planar array and is apparently directed to such an array where hung in what is effectively a free field. The spacing between adjacent speakers is not equidistant, but logarithmically progressive. Filtering of the audio signal and selected delay may be applied to control beam width and direction, respectively. The '395 patent states that "By not making the mutual spacing of the loudspeakers equidistant but adapting it to the frequency requirements, it is possible to control the directional sensitivity (the "transmission angle") up to, certainly, 8 kHz. The side lobe level is reduced at the same time." Indeed the '395 patent seems directed to extending directional sensitivity from the 1400 Hz range up to as close to 8 kHz feasible, and thus, for audio purposes, should be considered a high frequency system. The '395 patent allows directional control over the principal axis of the sound field, which allows for the possibility of end fire. The '395 patent discusses controlling what it terms the "opening angle". The opening angle is defined as the angle through which a sound source can be turned such that the sound pressure does not fall by more than 6 DB with respect to the maximum value which is measured at a fixed point in a plane in which the sound source is located . . . " in effect, beam width. The opening angle can be selected by choice of the FIR or IIR filter coefficients and the transmission angle can be selected by adjusting delay times.

SUMMARY OF THE INVENTION

According to the invention there is provided a loudspeaker array in which a plurality of at least three similar loudspeakers are arranged for generation of a sound field having a principal axis. At least first and second pairs of mutually spaced loudspeakers are spaced along the principal axis, with the spacing between the first pair differing substantially from the distance separating the second pair. An audio signal source and delay means are coupled for the excitation of the loudspeakers resulting in generation of an end fire sound field.

In a first embodiment, a plurality of at least three similar loudspeakers is arranged linearly along the principal axis. In another embodiment, the loudspeakers are arranged in a triangular array with a base row of a plurality of loudspeakers linearly aligned perpendicular to the principal axis and the principal axis passing through a loudspeaker located at a vertex of the array. The array is operated in a frequency range where the loudspeakers function as near simple sound sources.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
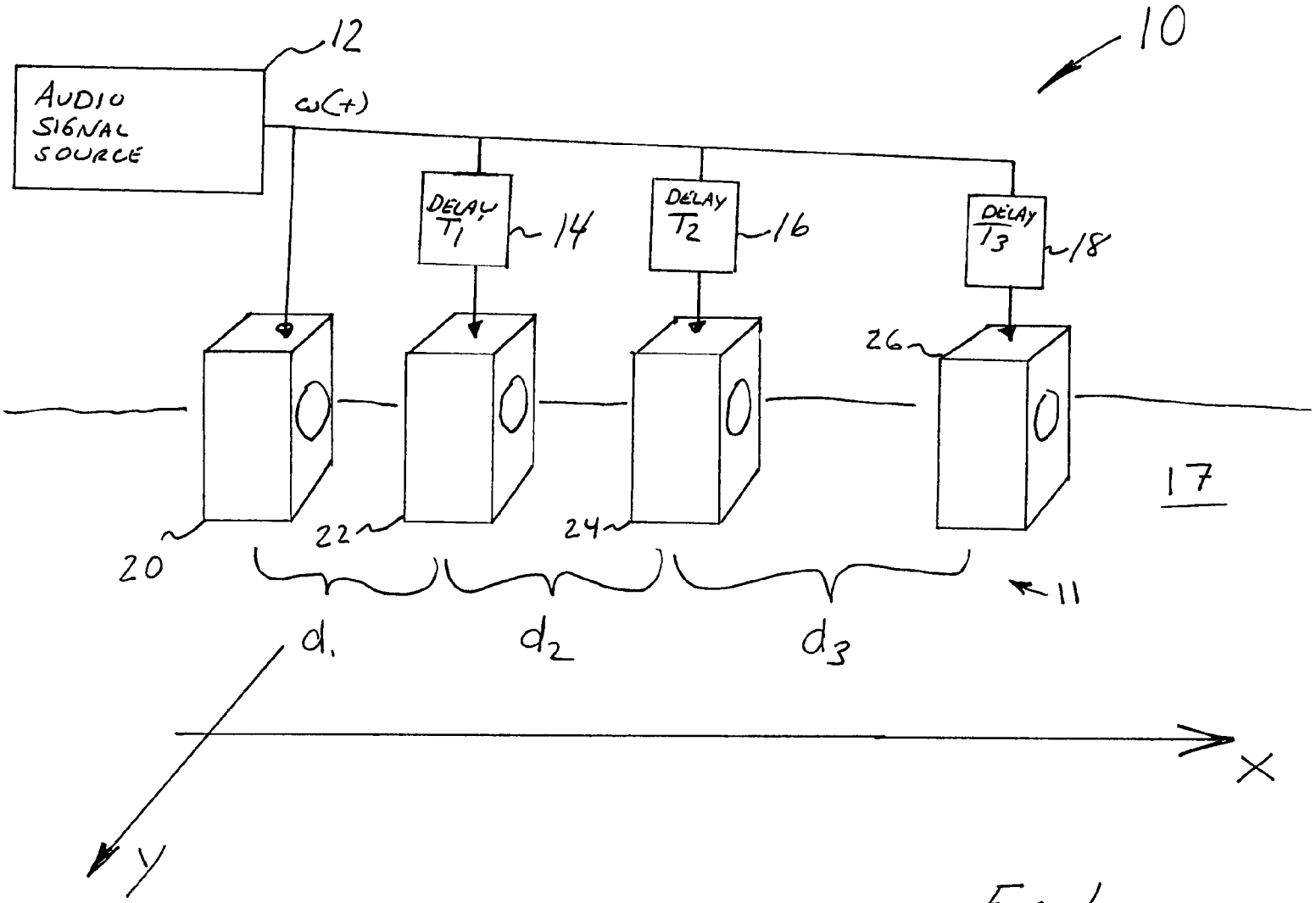
FIG. 1 is a diagrammatic view of an audio system in accordance with the invention.

Referring now to the figures and in particular to FIG. 1, an audio system 10 for the projection of highly directed bass sound in accordance with the invention is illustrated. An audio signal source 10 provides a time varying, bass, audio signal ω(t) which is applied to an array 11 of four bass loudspeakers 20, 22, 24, 26. Array 11 is a monolithic array with the four loudspeakers 20, 22, 24, 26 aligned front to back along the principal axis of projection, which is parallel to the x-axis. Loudspeaker 20 may be taken to be the "back" of the array with reproduced sound directed primarily in the direction "x". Such arrays are sometimes termed "end-fire" arrays. The audio signal is applied undelayed to loudspeaker 20, and is applied, progressively delayed to each subsequent loudspeaker in the array 22, 24, 26. Delay lines 14, 16, 18 apply delays $T_1$, $T_2$, $T_3$, respectively to the signal as applied to loudspeakers 22, 24, 26, as determined by the distance of the loudspeakers from the first loudspeaker 20. The delays may considered to be the equivalent of applying a phase shift to the signal if a particular frequency is used. The array 11 is intended to be bounded below by the ground 17.

Known linear arrays of end firing loudspeakers employ equal spacing between adjacent loudspeakers. In the preferred embodiment of the invention distances d1, d2, d3 between adjacent loudspeakers are unequal to one another, and preferably increase with spacing from the base loudspeaker 20, i.e. d3>d2>d1. The delays T1, T2, T3 of course correspond to the respective distances, d1, d2, d3. It is not strictly necessary that the loudspeakers be placed precisely on the intended principal axis of the propagated sound beam, and they may be placed straddling the axis x.

Empirical evaluation of arrays of varying spacing suggests a cost effective system providing good directional and focus control is obtained using four loudspeakers which are progressively spaced, with $d_1$=24", $d_2$=32" and $d_3$=48". Loudspeaker 20 (point of origin) is preferably driven with no delay and straight phase settings. Loudspeaker 22 is preferably operated with a 1.77083 msec delay and band limited phase adjustment to coincide arrival linearity with the output wave from loudspeaker 20. Loudspeaker is operated at a 4.14583 msec delay and again band limited phase adjustment is used to correspond to the two distances summed. Finally, the delay for loudspeaker 26 is set at 7.68750 msec with band limited phase adjustment to coincide arrival linearity over the three distances.

Figure 2:
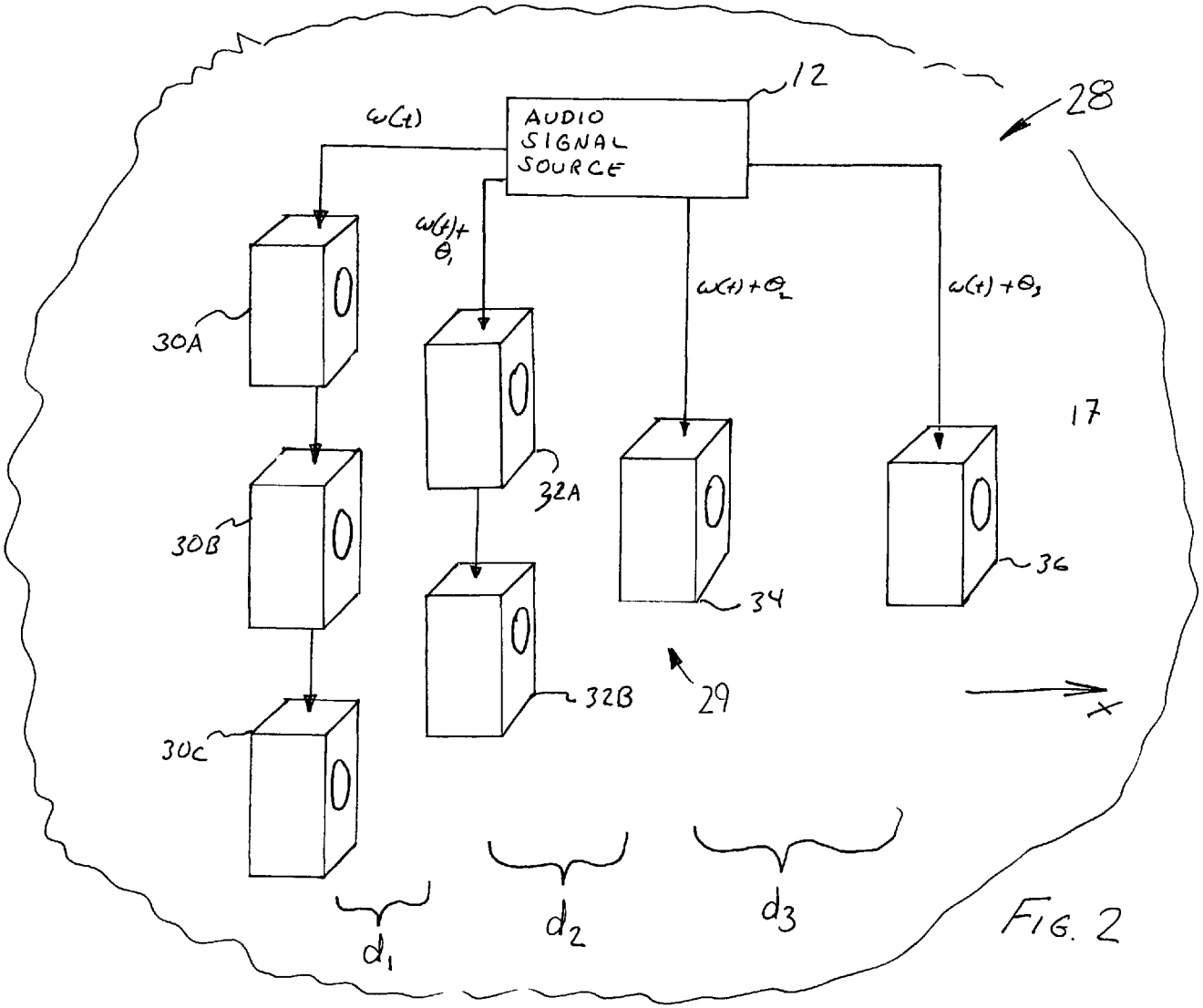
FIG. 2 is a diagrammatic view of an audio system in accordance with the invention.

Referring to FIG. 2, a second embodiment of the invention is illustrated. Here an audio system 28 comprises a triangular (or pyramid) array 29 of loudspeakers 30A, 30B, 30C, 32A, 32B, 34 and 36. The principal axis of the sound field generated by array 29 is parallel to the x-axis putting the row of loudspeakers 30A-C at the base of the pyramid or triangle bounded below by the ground 17.

Figure 3:
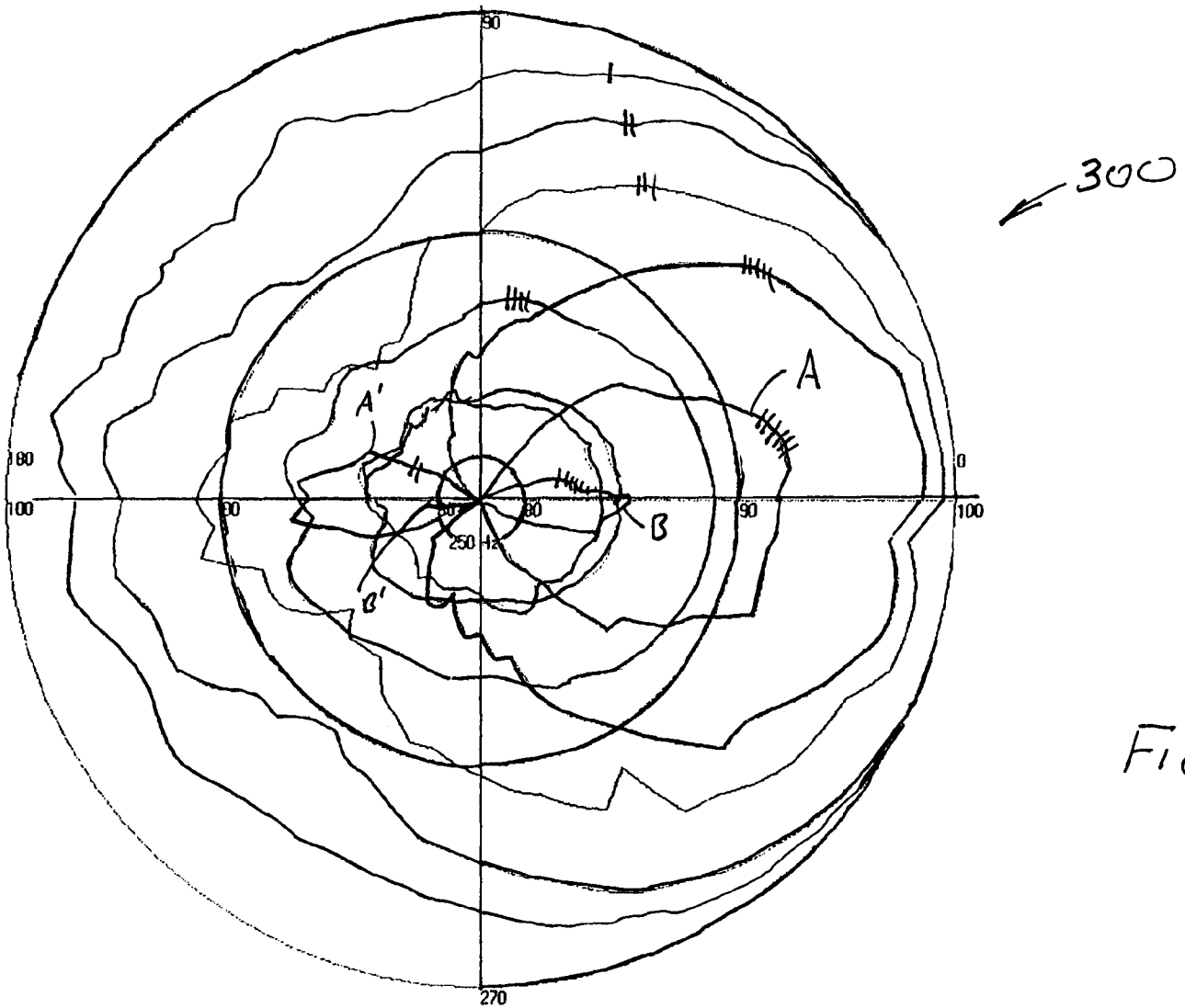
FIG. 3 is an acoustic pattern for sound fields produced by arrays of loudspeakers in accordance with the invention.

Referring to FIG. 3, a plurality of sound fields are illustrated in a polar graph 300. Curves A and B represent the forward fields from end fire arrays constructed in accord with the teachings of the invention at selected frequencies. Curves A' and B' illustrate backward propagated fields, which are substantially attenuated compared with the forward fields.

Figure 4:
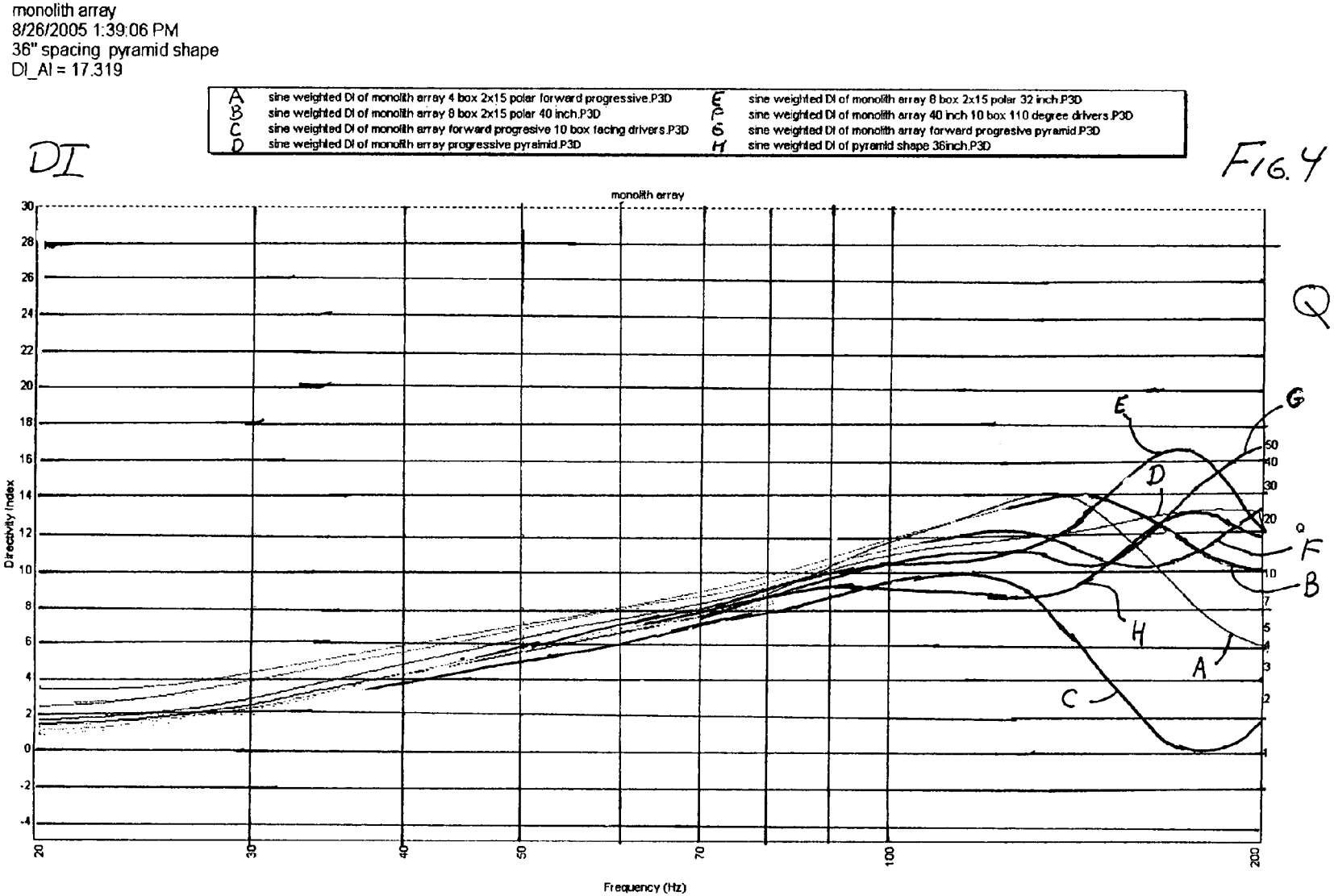
FIGS. 4-6 are graphs of the directivity index against frequency for arrays of the loudspeakers constructed in accordance with the invention.

FIG. 4 illustrates directivity index (DI) and Directivity Factor (Q) against frequency from 20 to 200 Hz. for a plurality of arrays. Curves A-H represent, respectively: (A) a monolithic 4 box array, linearly arranged, with increasing spacing in the direction of forward propagation of the sound field; (B) is for a monolithic array of 8 loudspeakers; (C) is a 10 loudspeaker box with increasing spacing in the forward direction; (D) is a progressively spaced array in a triangular pattern; (E) is a monolithic array of 8 loudspeakers of smaller aperture than the array of curve B; (F) is for a monolithic array of 40 inch, 10 boxes with 110 degree drivers; (G) is for a monolithic array of forward progressively spaced speakers, arranged in a triangle; and (H) is a triangular arrangement of 36 inch P3D units. Higher DI and Q results are generally preferred, reflecting tighter control over directedness of the beam. A rising DI and Q over the entire frequency range of interest (i.e. up to 200 Hz.) is also desirable. With these qualifications, curve G, representing a triangular array of loudspeakers, with an apex represented by a single loudspeaker furthest forward along the intended principal axis of a sound beam and each row of loudspeakers progressively further spaced from loudspeakers toward the back of the array, exhibits the best results, with DI and Q rising over most of the frequency range and still rising at 200 Hz.

Figure 5:
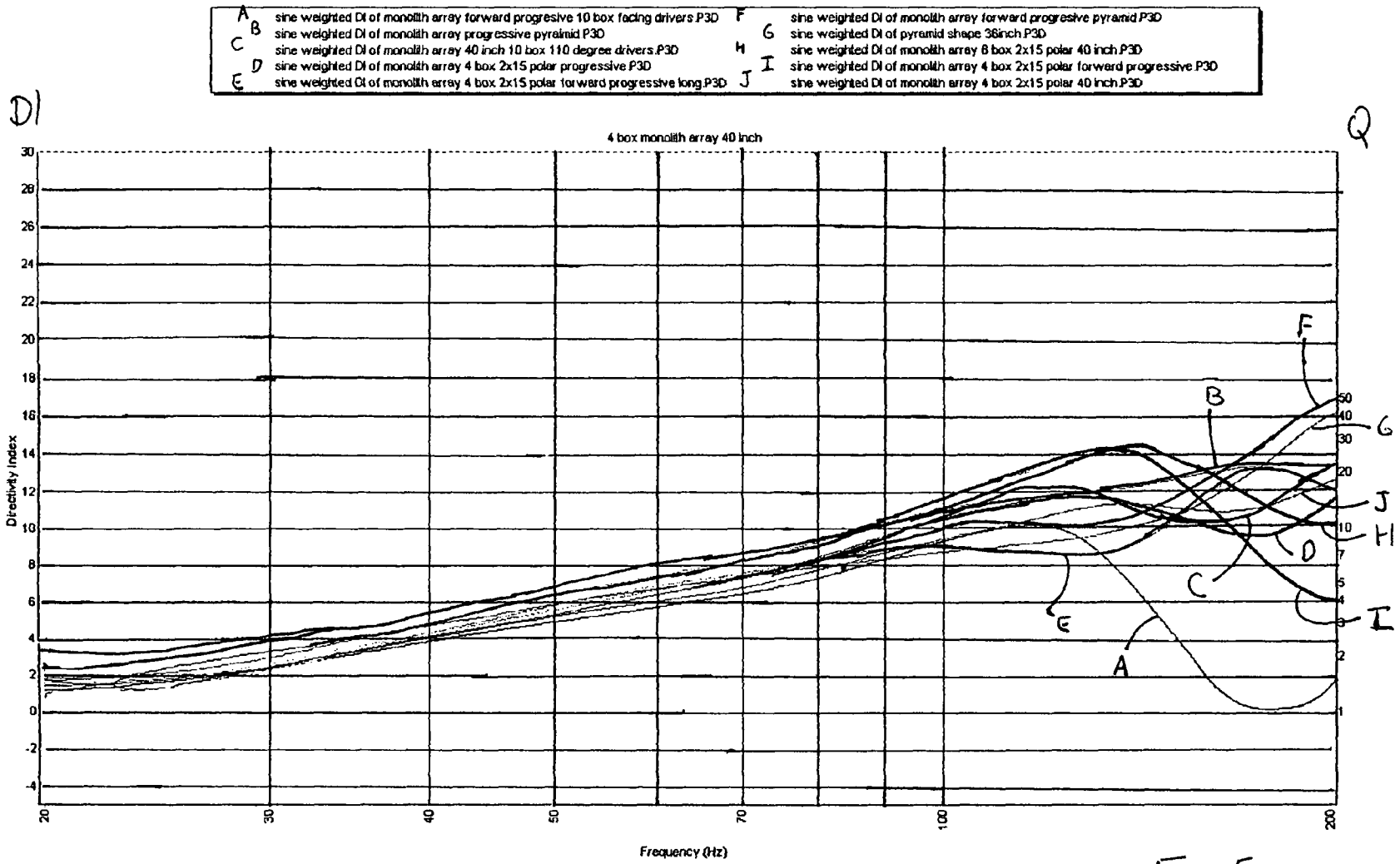

FIG. 5 graphically illustrates measurements of directivity index (DI) and Directivity Factor (Q) against frequency from 20 to 200 Hz. for selected arrays. Curves A-J represent, respectively: (A) a monolithic 10 box array, linearly arranged, with increasing spacing in the direction of forward propagation of the sound field. This arrangement produced the least desirable results with DI and Q peaking at a low level and at a relatively low frequency and peak; (B) is for a monolithic array arranged in triangular fashion with progressive spacing. DI and Q rise over the entire frequency range in question to a relatively high level; (C) is a conventional 10 loudspeaker linear array; (D) is a progressively spaced linear array exhibiting a relatively high frequency peak, and a slight turn down in DI and Q with increasing frequency before returning to an increasing pattern; (E) is a monolithic linear array of 4 loudspeakers with progressive forward spacing exhibiting a high peak DI and Q at a relatively high frequency for the range in interest; (F) is for triangular array with progressive forward spacing, which exhibits the highest Q and DI observed for the group, reaching its peak DI and Q at 200 Hz.; (G) is another example of a triangular array with progressive forward spacing, exhibiting similar results to curve F of this figure; (H) is a linear array of 8 units with regular spacing; (I) is a linear array with progressive forward spacing but only 4 of the type of units used for the array of curve H, providing a comparable peak DI and Q, but exhibiting a faster fall off with increasing frequency; and (J) is a conventional linear array using loudspeakers similar to those used for the array of curve I.

Figure 6:
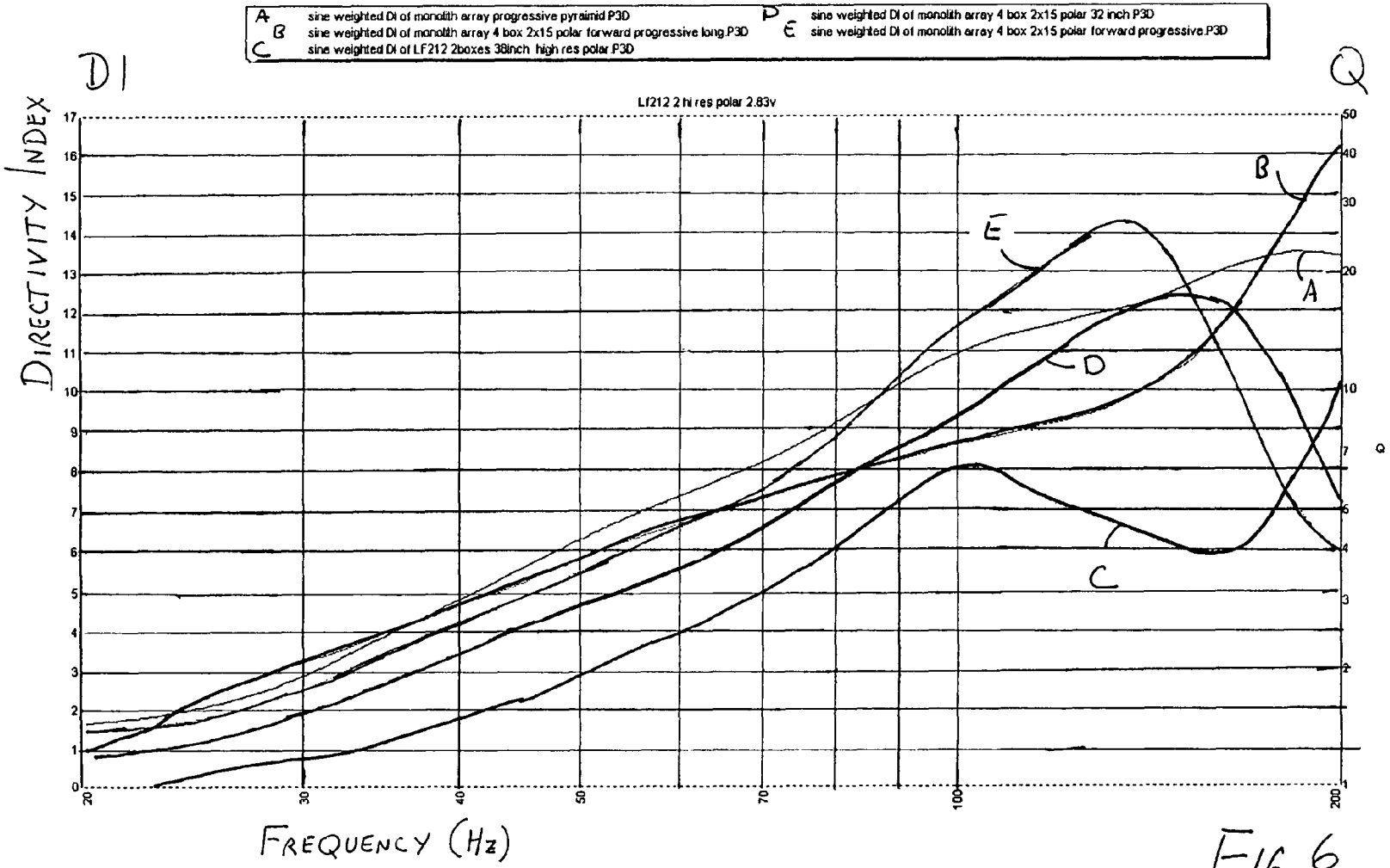

FIG. 6 highlight particularly effective arrays, all using ground effect to suppress the back wave, where: (A) the array of curve "A" is a triangular array with forward progressive spacing and exhibits rising DI/Q over substantially all the measured range of 20 to 200 Hz., peaking just short of the maximum frequency; (B) the array of curve "B" is another linear array with forward progressive spacing exhibiting a rising Q and DI over the entire range of interest and having a particularly advantageous Q and DI which peak at selectable frequencies; (C) this array is a conventional linear array with regular spacing; (D) is a regularly spaced linear array; (E) is a monolithic linear array of 4 loudspeakers with progressive forward spacing exhibiting a high peak DI and Q at a relatively high frequency for the range in interest and a steep drop off.

The differential, preferably progressive spacing of end fire arrays produces unexpected improvements in narrowing the beam width of the sound beam, offering the possibility of a beam width (with 6 DB drop off) of as little as 70 to 80 degrees.

While the invention is shown in only a few of its forms, it is not thus limited but is susceptible to various changes and modifications without departing from the spirit and scope of the invention.

What is claimed is:

1. A loudspeaker array comprising:

a plurality of at least three similar bass range loudspeakers arranged relative to an intended principal axis of a cardioid sound field for end fire generation of the cardioid sound field from the loud speaker array;

at least first and second pairs of mutually spaced loudspeakers from among the plurality of at least three similar bass range loudspeakers, with the second pair of loudspeakers following the first pair of loudspeakers for end fire generation of sound and the space separating the loudspeakers of the first pair of mutually spaced loudspeakers being substantially less than the space separating loudspeakers of the second pair of mutually spaced loudspeakers parallel to the principal axis; and an audio signal source and processing means coupled to apply a bass audio excitation signal of the same frequency spectrum to the plurality of at least three bass range loudspeakers with appropriate delays to selected bass range loud speakers for producing the end fire generation of the cardioid sound field.

2. A loudspeaker array in accord with claim 1, further comprising the plurality of at least three similar bass range loudspeakers being arranged linearly along the principal axis.

3. A loudspeaker array in accord with claim 1, further comprising a plurality of four similar bass range loudspeakers, the similar bass range loudspeakers being arranged in a triangular array with a base row having a plurality of loudspeakers linearly aligned on one another perpendicular to the principal axis.

4. A loudspeaker array in accord with claim 1, wherein the frequencies of operation of the audio signal source are chosen such that the plurality of at least three similar loudspeakers operate as near simple sound sources.

5. A method of generating a sound field exhibiting a cardioid pattern around a principal axis and with high directivity index, the method comprising the steps of:

(A) providing a plurality of similar loudspeakers;

(B) positioning the plurality of similar loudspeakers along a line for end fire generation of sound with the loudspeakers exhibiting minimum spacing at one end of the line and spaced at progressively greater distances in the direction of end fire sound generation;

(C) supplying a bass audio drive signal with a time varying frequency spectrum; and (D) applying the bass audio drive signal to the positioned loudspeakers, delaying the bass audio signal to particular loudspeakers being a function of location relative to the principal axis.

6. A method of generating a sound field in accord with claim 5, the step of positioning further comprising:

aligning the loudspeakers with the principal axis.

7. A method of generating a sound field in accord with claim 5, the step of positioning further comprising:

arraying the plurality of similar loudspeakers in a triangular formation with at least two loudspeakers being aligned with a first selected point and diminishing numbers of loudspeakers spaced at progressively greater distances in a predetermined direction along the principal axis corresponding to an intended direction of propagation of sound.

8. Apparatus for controlling beam width in a bass range cardioid sound field and suppressing subsidiary lobing around the bass range cardioid sound field and back field projection opposite a primary direction of propagation, the apparatus comprising:

a plurality of loudspeakers arranged in depth along an axis of propagation for the sound beam in at least three subgroups;

said at least three subgroups being spaced at varying distances along the axis of propagation with the distance between subgroups exclusively increasing in the primary direction of propagation;

a ground effect barrier parallel to the axis of propagation;

a source of a bass audio signal connected to the subgroups of loudspeakers; and delay lines providing the connection between the source of the bass audio signal and subgroups of loudspeakers located forward along the axis of propagation.

9. Apparatus in accord with claim 8, further comprising:

four subgroups of loudspeakers comprising a single loudspeaker each, arranged linearly along the axis of propagation.

10. Apparatus in accord with claim 8, further comprising:

the subgroups of loudspeakers being arranged in a triangular pattern in a plane parallel to the ground effect barrier, one vertex of the triangular pattern corresponding to a subgroup of one loudspeaker disposed on the axis of propagation.

* * * * *